US006450499B1

(12) United States Patent
Letang

(10) Patent No.: US 6,450,499 B1
(45) Date of Patent: Sep. 17, 2002

(54) EDUCATIONAL WORD GAME AND METHOD FOR EMPLOYING SAME

(76) Inventor: Henry A. Letang, 2 Longmeadow Cir., Madison, WI (US) 53717

( * ) Notice: Subject to any disclaimer, the term of this patent is extended or adjusted under 35 U.S.C. 154(b) by 0 days.

(21) Appl. No.: 09/917,131

(22) Filed: Jul. 27, 2001

Related U.S. Application Data

(63) Continuation-in-part of application No. 09/791,250, filed on Feb. 23, 2001.

(51) Int. Cl.[7] ..... A63F 3/00

(52) U.S. Cl. ..... 273/272; 273/299; 434/157; 434/159; 434/160; 434/167; 434/171

(58) Field of Search ..... 273/272, 299; 434/128–129, 159–160, 167, 171, 157

(56) References Cited

U.S. PATENT DOCUMENTS

| | | | | | |
|---|---|---|---|---|---|
| 1,100,549 | A | * | 6/1914 | Elkins | |
| 3,235,976 | A | * | 2/1966 | Elliott et al. | 35/35 |
| 3,524,648 | A | * | 8/1970 | Nilan | 273/153 |
| 3,728,800 | A | * | 4/1973 | Magram | 35/35 J |
| 3,746,342 | A | * | 7/1973 | Fine | 273/135 D |
| 4,299,391 | A | | 11/1981 | Silver | |
| 4,350,342 | A | * | 9/1982 | Barulich | 273/240 |
| 4,365,813 | A | | 12/1982 | Hirsch | |
| 4,550,915 | A | | 11/1985 | Meyer | |
| 4,735,419 | A | | 4/1988 | Koca | |
| 4,923,199 | A | * | 5/1990 | Hahn | 273/299 |
| 4,934,700 | A | | 6/1990 | Turek | |
| 4,955,614 | A | * | 9/1990 | Buda | 273/240 |
| 5,100,150 | A | | 3/1992 | Larman | |
| 5,145,183 | A | | 9/1992 | Gates | |
| 5,149,103 | A | * | 9/1992 | Ross | 273/432 |
| 5,207,435 | A | * | 5/1993 | Tanner | 273/429 |
| 5,556,102 | A | | 9/1996 | Huang | |
| 5,558,328 | A | | 9/1996 | Krantz | |
| 5,743,740 | A | | 4/1998 | Visser et al. | |
| 5,752,701 | A | * | 5/1998 | Kao | 273/269 |
| 5,769,421 | A | | 6/1998 | Wakefield | |
| 5,799,943 | A | | 9/1998 | Morgan | |
| 5,803,742 | A | * | 9/1998 | Buti | 434/157 |
| 5,899,698 | A | * | 5/1999 | Sandlin | 434/157 |
| 5,951,297 | A | | 9/1999 | Schwartz | |
| 5,953,692 | A | * | 9/1999 | Siegel | 704/1 |
| 6,098,983 | A | | 8/2000 | Kennedy | |
| 6,168,439 | B1 | * | 1/2001 | Anderson | 434/167 |
| 6,199,863 | B1 | * | 3/2001 | Chan | 273/236 |

* cited by examiner

*Primary Examiner*—Valencia Martin-Wallace
*Assistant Examiner*—Scott E. Jones
(74) *Attorney, Agent, or Firm*—Patricia Smith King

(57) ABSTRACT

The present invention is an educational word game and method of playing same that may be provided in single or bi-lingual versions and that challenges players to form as many new words from a set of at least two base words as possible within a limited amount of time. The word game requires that the players define a set of rules for each game prior to play and by the random selection of round prize amounts and the letter length of the at least two base words, and thus the number and type of letters players may use to form new words. Base word letter length and prize amounts are determined by spinning a pointer on the board. Players fill in a game rules sheet. By requiring that two or more base words be used, the number, length, and sophistication of words a player may potentially make is greatly expanded.

39 Claims, 6 Drawing Sheets

10
14
18
12
16
$1,000
$10,000
$500
$1,000
$5,000
$700
$500
$10,000
$1,000
$5,000
$700
$500
$10,000
$1,000
$5,000
$700
$500
$10,000

FIG. 2a

20

GAME RULES SHEET
[Select from the following options to specify a rule set for current game]

RULE 1: Time limit rule – time limit per round of play is: 26
- ☐ 1 minute
- ☐ 2 minutes
- ☐ Other (players specify) _____

RULE 2: Qualifying type of new word rule – type of new words formed that qualify for credit in round scoring: 28
- ☐ Proper words.
- ☐ Country names.
- ☐ US President last names.
- ☐ Other (players specify) _____

RULE 3: Criterion for round win – round winner determined by player with: 30
- ☐ Most words formed.
- ☐ Most words formed of base word letter length or greater.
- ☐ Longest word formed.
- ☐ Greatest total score – each word counts no. of points based on no. of letters in word: 3-5 = 2pts; 6-7 = 5pts; >8 = 15 pts.
- ☐ Other (players specify) _____

RULE 4: Criterion for game win – game winner determined by: 32
- ☐ First player to gain $10,000.
- ☐ First player to gain $20,000.
- ☐ Other (players specify) _____

RULE 5: Language of play – if bi-lingual version of game, language of play is: 34
- ☐ English
- ☐ Spanish
- ☐ French
- ☐ Other (players specify) _____

24

22

FIG. 2b

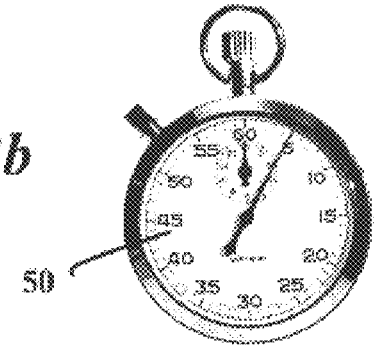

FIG 5a

| WORDS (no. letters) | TOTAL NO. WORDS OF 4 OR MORE LETTERS EACH | TOTAL WORDS OF 7 OR MORE LETTERS |
|---|---|---|
| Fire (4) | 1 | --- |
| Lone (4) | 2 | --- |
| Fire+Lone (8) | 63 | 0 |
| Promise (7) | 72 | 3 |
| Anagram (7) | 6 | 0 |
| Promise+Anagram (14) | 739 | 161 |
| Aromatical (10) | 102 | 7 |
| Opalescent (10) | 398 | 24 |
| Opalescent+Aromatical (20) | 4004 | 1785 |

FIG 5b

PROMISE

| No. of Letters | No. Combinations | Words formed from available letters |
|---|---|---|
| 4 | 37 | Emir, eros, imps, ipso, ires, mire, mope, mops, more, oems, orem, ores, peso, pier, pies, poem, pore, pose, pres, prim, prom, pros, rime, rims, ripe, rips, rise, rome, romp, roms, rope, rose, rpms, semi, sire, some, sore. |
| 5 | 26 | Emirs, eprom, Epsom, mires, miser, moiré, mopes, mores, morse, osier, piers, poems, poise, pores, poser, pries, prime, prism, proem, proms, prose, romps, ropes, sperm, spire, spore. |
| 6 | 6 | Eproms, impose, isomer, primes, proems, simper. |
| 7 | 8 | Imposer, semipro. |
| **TOTAL:** | 77 | **different word combinations of 4 or more letters each.** |

FIG 5c

ANAGRAM

| No. of Letters | No. Combinations | Words formed from available letters |
|---|---|---|
| 4 | 4 | Agar, gram, raga, rang. |
| 5 | 0 | |
| 6 | 1 | Ragman. |
| 7 | 0 | |
| **TOTAL:** | **5** | **different word combinations of 4 or more letters each.** |

*FIG 6*

PROMISEANAGRAM

| No. of Letters | No. Combinations | Words formed from available letters |
|---|---|---|
| 4 | 199 | Aeon, agar, ages, aims, airs, amen, ames, ammo, amos, amps, ansi, apes, apse, area, area, aria, arms, asap, asia, earn, ears, egos, emir, emma, eras, ergo, erma, erna, eros, errs, gain, game, gape, gaps, gasp, gear, gems, . . . |
| 5 | 207 | Aaron, aegis, aeons, again, agape, agars, agnes, aimer, aires, amens, amigo, amino, among, anger, anise, aping, apron, areas, arena, argon, arian, arias, aries, arise, armor, aroma, arose, arras, arson, asian, . . . |
| 6 | 172 | Aimers, airman, airmen, amigos, anemia, angers, angora, anomie, aprons, arenas, argons, arisen, armies, arming, armors, aromas, aspire, easing, egoism, enamor, engram, enigma, eproms, erring, gainer, gamier . . . |
| 7 | 108 | Agonies, ammonia, amnesia, anemias, angoras, angrier, apogean, Armenia, arraign, arrange, aspirer, earring, emporia, enamors, engrams, enigmas, epigram, erasing, gainers, gammons, garners, germans, grammar, grimmer, gripers, groaner, gropers, ignorer, ignores, imposer, magpies, maimers, manager, manages, mangers, mangier, mangoes, margins, marinas, mariner, marines, marries, marring, memoirs, merinos, mirages, Miramar, misname, moaners, mongers, moraine, Niagara, oarsman, oarsmen, opiners, oranges, paragon, pairings, parries, parsing, Persian, persona, pigeons, pingers, porgies, praiser, primers, primmer, program, promise, prosier, prosing, ramming, rampage, ramping, rangers, rangier, rapiers, rapines, raspier, rasping, reaming reaping, rearing, regains, regions, remains, remoras, repairs, ringers, roamers, roaming, roaring, romaine, Romania, rompers, romping, sangria, searing, seminar, semipro, signora, soapier, soaping, soaring, sparing, sponger. |
| 8 | 39 | Agrarian, ammonias, anagrams, armories, armoring, arraigns, arranges, earrings, epigrams, garrison, grammars, groaners, ignorers, magnesia, managers, mariners, marriage, misnomer, moraines, organism, paganism, panorama, paragon, paranoia, parmesan, primrose, prisoner, programs, promiser, rampages, ransomer, rearming, reposing, sagamore, smearing, sparring, spearing, spongier, springer. |
| 9 | 11 | Agrarians, granaries, margarine, marriages, mismanage, panoramas, paranoias, parsonage, persimmon, repairman, singapore. |
| 10 | 2 | Grammarian, margarines. |
| 11 | 1 | Grammarians. |
| 12 to 14 | 0 | |
| **TOTAL:** | **739** | **different word combinations of 4 or more letters each.** |

EDUCATIONAL WORD GAME AND METHOD FOR EMPLOYING SAME

CROSS REFERENCE TO RELATED APPLICATIONS

This is a continuation-in-part of application Ser. No. 09/791250, filed Feb. 23, 2001.

BACKGROUND

The present invention relates to word games used for entertainment and educational purposes, specifically to word games that enable a player to form new longer words out of at least two base words under a player selected rules set, and that encourage language learning by the provision of word definitions in one or two languages.

There are many word games in existence that challenge a player to form new words from a limited number of letters. The letters available to a player are generally either provided by drawing from a pool of individual letters or by using only those letters in a selected base word. The player then has a limited amount of time to form as many new words as possible by rearranging the base letters. The number of letters a player has to work with is generally limited by the number of individual letters he or she is allowed to draw or by the number of letters in the base word. In either case, the longest word a player can possibly form, is limited by the number of letters available. If seven letters are available to a player, the longest word that player can form is a 7-letter word. This necessarily limits the educational challenge presented a player. Generally, longer words are more difficult and challenging to create.

The educational challenge and entertainment value of word games is likewise limited by the limitation that new words formed are proper words only, the lack of random elements to the game such as the prize amount to be won in a round of play and/or the limited set of ways to play a game.

SUMMARY

The present invention is directed to overcoming these limitations by providing a word game that significantly enlarges the potential size and number of words a player may make through the use of multiple base words. It also increases the entertainment and educational value of the game by enabling the same game pieces to be used in different ways under a variety of rule sets to new and different outcomes. The present invention introduces a random element to increase its entertainment value by providing a pointer to be spun on a game board to determine the number of letters in the set of at least two base words to be played in a round and the prize amount to be awarded to the round winner. The present invention also provides a game rules sheet to increase both the entertainment and educational aspects of the game by enabling players to select from among at least two optional definitions per type of rule on the rules sheet to create a new rules set for each game played.

The player-specified rules set varies the game's challenge level. For example, the time limit during which new words may be formed may be lengthened or shortened; the type of new words that qualify for credit may include all proper words or may be limited to certain kinds of words such as country names, U.S. President's names, or the like; the criterion for determining a round winner may be set to the greatest number of words formed, or may be set to a more challenging criterion such as the greatest number of words formed of the base word length or greater; the criterion for determining a game winner may be set to a certain total prize amount, or may set to some other criterion such as the player who has formed the longest word in a specified number of rounds of play; and, in bi-lingual versions of the game, the language of play may be set to the native language of the players or to the second language to challenge players to form new words in another language. In this way, one game set provides a variety of game types and levels from which players may choose.

BRIEF DESCRIPTION OF DRAWINGS

In the accompanying drawings:

FIGS. 1*a* to 1*f*, are depictions of the main components of the word game, including the game board (FIG. 1*a*), the game rules sheet (FIG. 1*b*), the game pieces and display stand (FIG. 1*c*), the writing paper and writing instrument (FIG. 1*d*), the storage container (FIG. 1*e*), and the timer (FIG. 1*f*).

FIG. 2*a*, is a representation of the game rules sheet with its main components labeled.

FIG. 2*b*, is a representation of an adjustable form of the timer, in this case a stopwatch.

FIGS. 5*a* to *c*, are illustrations of the number and type of new words that may be formed from base word(s) of variable base word lengths. FIGS. 5*b* and 5*c*, illustrate the new words potentially formed from the base words anagram and promise.

FIG. 6, is an illustration of the possible new words formed when the two base words anagram and promise, are combined in play.

DESCRIPTION—Word Game

Figure 1A:
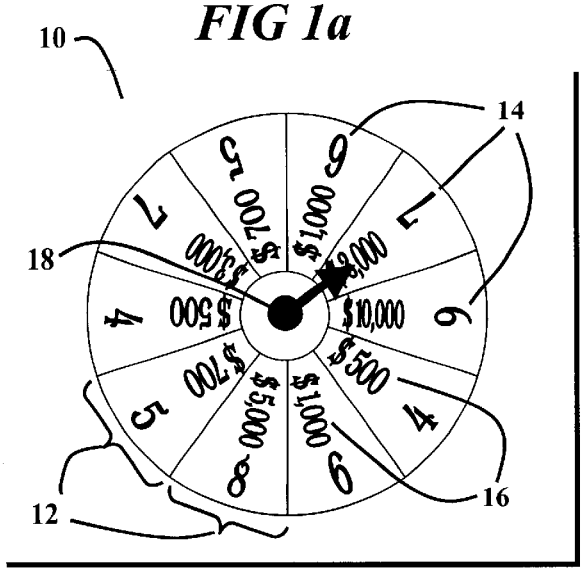

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

The word game of the present invention is comprised of a plurality of components. Referring now to FIGS. 1*a*–1*f*, the main components of the word game are depicted.

A game board 10 is depicted in FIG 1*a*. The game board 10 is subdivided into a plurality of subdivisions 12 radiating outward from the center of the game board 10, each subdivision 12 being marked with a value for a base word length 14 and a round prize amount 16. A pointer 18 is rotatably attached to the center of the game board 10. The game board 10 may be square as depicted, or may be round in shape. The outer border of the subdivisions 12 may form a circle as depicted, or the subdivisions may extend to the border of the game board 10.

A game rules sheet 20 is provided with the word game and is depicted in FIG. 1*b* and FIG. 2*a*. Referring to FIG. 2*a*, the various parts of the game rules sheet are labeled. The game rules sheet lists a plurality of game rules 22 and a group of at least two optional definitions 24 for each of the plurality of game rules 22. The plurality of game rules 22 comprise a time limit rule 26 (depicted as Rule 1), a type of new words rule 28 (depicted as Rule 2), a round winner rule 30 (depicted as Rule 3), a game winner rule 32 (depicted as Rule 4), and with bi-lingual versions of the game, a language of play rule 34 (depicted as Rule 5). Checkboxes are listed next to each of the optional definitions to enable players to easily check off their selections (an example of a marked rules sheet 20 is given in FIG. 1*b*).

The group of at least two optional definitions 24 may include a variety of options, but as illustrated by way of example in FIGS. 1*b* and 2*a*, are: time limit rule 26 optional definitions 24 of one minute, two minutes and a player-specified limit; type of new word 28 optional definitions 24 of proper words, country names, U.S. President's names and a player-specified type; criterion for round win 30 optional definitions 24 of most words formed, most words formed of the base word length or greater; longest word formed; greatest total score and a player-specified criterion; and, criterion for game win 32 optional definitions 24 of first player to gain $10,000, first player to win $20,000, and a player-specified criterion. Allowing players to specify their own definitions for all or just some of the game rules, enables them to create numerous different games to be played.

The game rules sheet 20 may be provided in a variety of forms including a piece of paper, a pad of multiple copies of the sheet 20, each copy to be used once for a given game, in a reusable form markable with an erasable marker, or the like.

A plurality of game pieces 36 are also provided as components of the word game and are depicted in FIGS. 1*c* and 1*e*, and in FIGS. 3*a* to 3*d*. Each game piece 36 comprises two broader surfaces forming a front surface and a back surface, and four narrower edge surfaces. On each front and back surface is indicated a base word 38, a pronunciation of the base word 40, a definition of the base word 42 and the base word length 14. The length of the base word 14 indicates the number of letters in the base word 38 and may be indicated numerically (as shown) or by color-coding or other means.

The game pieces 36 may be provided in a variety of forms including cards or flattened blocks and may be constructed of a variety of stiff materials including paper, plastic, wood or metal.

Figure 3A:
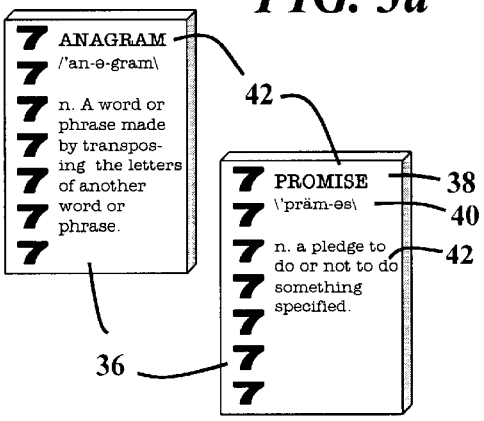
FIGS. 3*a* to 3*d*, are illustrations of the front and back surfaces of the playing pieces as they might appear in single language versions of the game (English— FIG. 3*a*; French— FIG. 3*b*) and in bi-lingual versions of the game (English-Spanish— FIG. 3*c*; English-French— FIG. 3*d*).
Figure 3B:
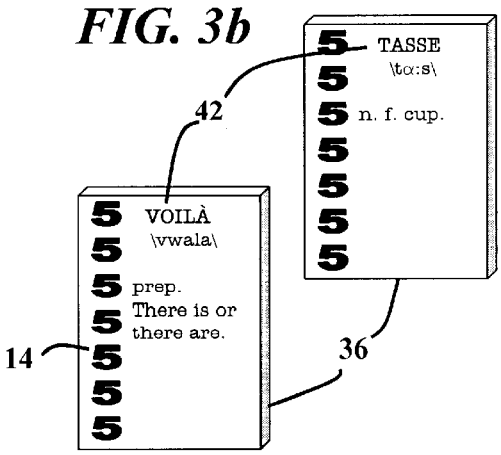
Figure 3C:
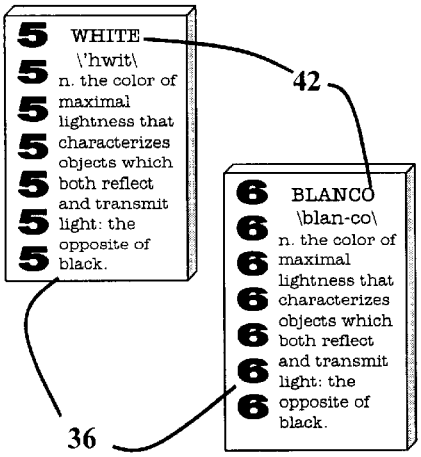
Figure 3D:
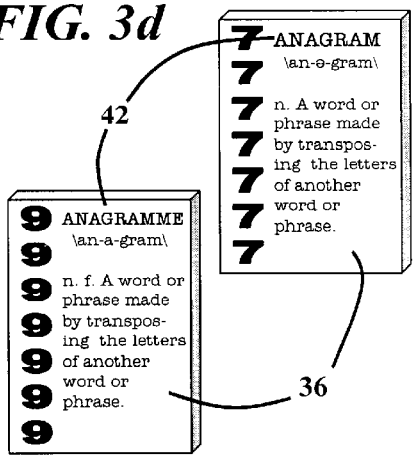

The base words 38 depicted on both the front and back surfaces of the plurality of game pieces 36 may be provided in one single language as depicted in FIG. 3*a* (English) and FIG. 3*b* (French). Alternatively, the base words 38 may be provided in one language on the front surface of the game pieces 36 and in another different language on the back surface as depicted in FIG. 3*c* (English and Spanish) and FIG. 3*d* (English and French). In this way, a bi-lingual version of the word game is provided. When the base words 38 are provided in two different languages, the base word 38 on both the front and back surfaces of a game piece 36 has the same meaning. In this way, the bi-lingual version of the word game provides players with a translation of a base word 38, thereby increasing the educational value of the word game.

The game pieces 36 that are selected for play in a round of the game, are optionally inserted into a display stand 46. In this way, the selected game pieces 36 and their respective base words 38 may be viewed by all players of the game. The display stand 46 may assume a variety of forms so long as it functions to hold the playing pieces 36 in full view of the players. As depicted in FIG. 1*c*, it is an elongated rectangular block with a slot positioned centrally in an upper surface of a size to allow a game piece 36 to be inserted therein and to be held upright. The display stand 46 may be provided in a variety of forms, however, that would function equally as well to display the game pieces 36 to the players.

The plurality of game pieces 36 may be stored in a variety of ways including in a storage container 48 (see FIG. 1*e*). The storage container 48 may be a simple box to fit the game pieces 36 provided with the word game, or it may be another sort of container such as a bag or the like. The word game may come with a plurality of storage containers 48, each coded for the storage of game pieces 36 depicting base words 38 of the same base word length 14. Other means may also be employed to sort the game pieces 36 by base word length 14 in order to facility choosing game pieces 36 of a particular base word length 14. For example, the storage container 48 may optionally be compartmentalized to store game pieces 36 by their base word length 14 (as shown in FIG. 1*e*).

A timer 50 is provided to time a round of play of the game (see FIG. 1*f*). The timer 50 may be of the simple hour-glass construction (as depicted in FIG. 1*f*) with enough sand to time a one or two-minute interval of time of the sort players are likely to choose as the time limit for a round of play when selecting a time limit rule 26 optional definition 24. A single one-minute timer 50 would allow the timing of play for any number of minutes by simply turning the timer 50 over after each minute and continuing to time subsequent minutes until the selected time limit is reached. Alternatively, the timer 50 may be an adjustable timer 52 such as a stopwatch (as depicted in FIG. 2*b*), a kitchen timer, or the like, to enable a player to set the timer 50 to a time interval of their choice.

A paper 54 and a writing instrument 56 are also provided for each of the players with which they may write down new words when playing the word game (see FIG. 1*d*). The paper 52 may be provided as single sheets or as pads of multiple sheets. The writing instrument 54 may be of a variety of sorts including a pencil, pen or the like.

DESCRIPTION—Method of Playing Word Game

Figure 4:
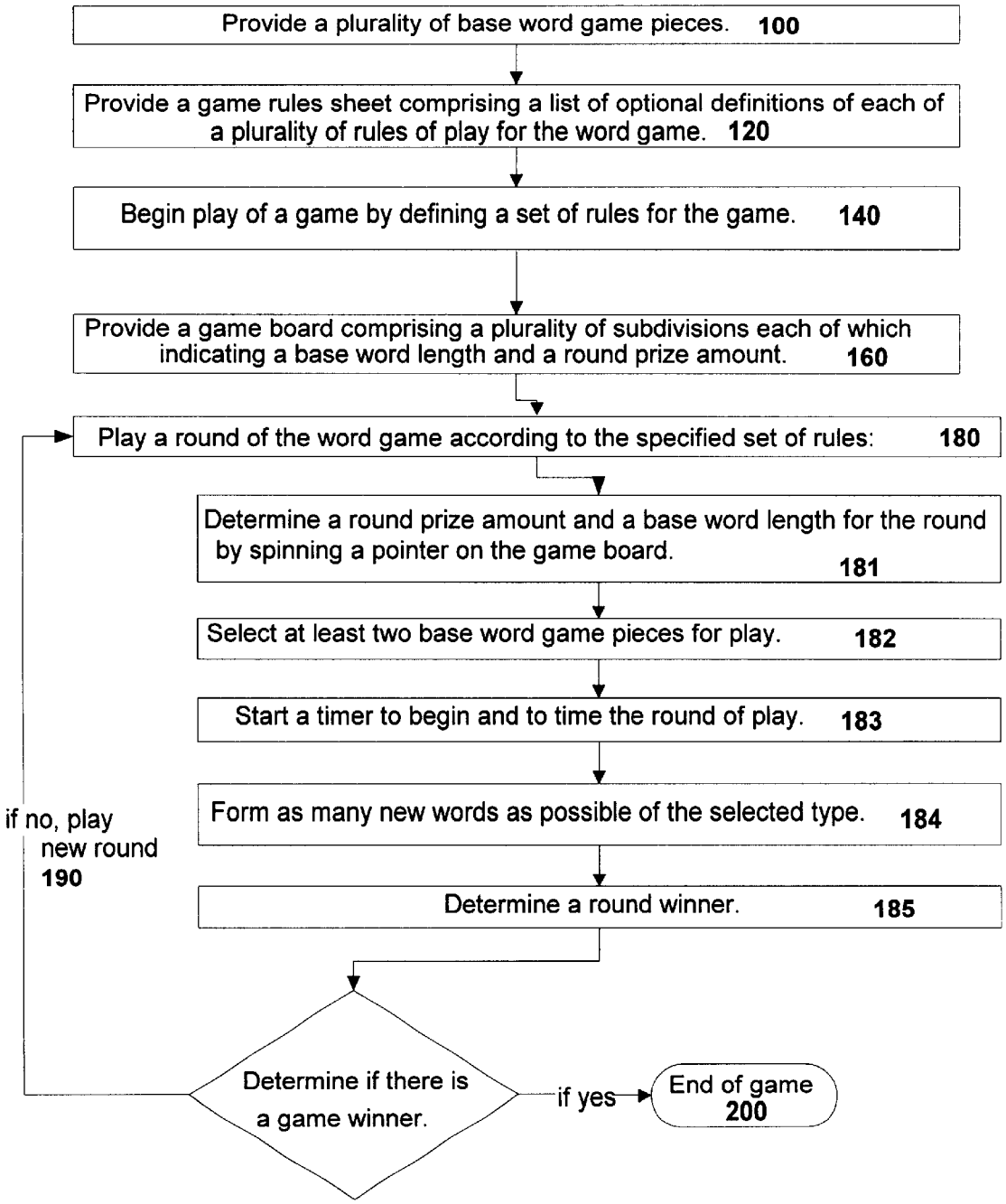
FIG. 4, is a flow chart of the basic steps in the method of playing the word game.

The basic method for playing the word game is depicted in the flow chart of FIG. 4. The steps of the method for playing the word game are described below.

Providing the plurality of game pieces 100. The game pieces 36 are provided as components of the word game. Each game piece comprising two broader surfaces forming a front surface and a back surface, and four narrower edge surfaces, each front and back surface having indicated thereon a base word 38, a pronunciation of the base word 40, a definition of the base word 42 and the base word length 14.

Note that the provision of additional information about each base word 38 allows players to discover the definitions of the words and how to pronounce them properly. This increases the educational value of the game over those that provide a base word only. In bi-lingual versions of the game, the provision of the same word translated into two languages enables language learning.

Providing a game rules sheet 120. A game rules sheet 20 is provided comprising a group of at least two optional definitions 24 for each of a plurality of game rules 22 for the word game. The plurality of game rules 22 comprise (1) a time limit rule 26 to specify a time limit for each of an at least one round of play; (2) a word category rule 28 to specify a category of new words to form (i.e., type, for example proper words, Country names, U.S. President last names, etc.; see FIG. 2*a*) that qualifies for credit in the at least one round of play, the category of new words being formed from a set of letters contained in at least two base words indicated on a selection of at least two of the plurality of game pieces 36; (3) a round winner rule 30 to specify how a round winner is to be determined for each of the at least one round of play; and, (4) a game winner rule 32 to specify how a game winner is to be determined, a game comprising the at least one round of play. There may also be a language of play rule 34 for specifying whether a game is to be played in the first language or the second language of a bi-lingual version of the word game.

Beginning play of a game 140. Play of a game is begun by defining a set of rules for the game, comprising selecting one option from the list of optional definitions 24 for each of the plurality of game rules 22.

Allowing players to select among optional definitions 24 for each of the plurality of rules 22 enables them to create their own new and varied combinations of play. In this way, the word game of the present invention allows for a great number of variations on the word game, allowing players themselves to determine its level of difficulty (primarily by setting the criterion of round win 30) and to provide players greater entertainment value through variation of play.

Providing a game board 160. The game board 10 comprises a plurality of subdivisions 12 radiating outward from a center of the game board and a pointer 18 rotatably attached to the center of the game board 10, each of the plurality of subdivisions 12 indicating a base word length 14 equal to a number of letters in each of the at least two base words 38 to be played in a current round of play and a round prize amount 16 to be awarded to a winner of the current round of play.

Playing a round of the word game 180. A round of the word game is played according to the specified set of rules for the game. The basic steps in a round of play comprise: (1) determining a round prize amount 16 and a base word length 14 for the round by spinning the pointer 18 on the game board 10 and noting the round prize amount 16 and the base word length 14 indicated on the subdivision 12 at which the pointer 18 lands 181; (2) selecting at least two base words 38 for play in the current round by selecting at least two of the plurality of game pieces 36 of the base word length 14 for the current round of play 182; (3) starting a timer 50 to begin the round of play and to time the round of play for the specified time limit 183; (4) forming as many new words of the selected type of new words as possible within the specified time limit from a set of letters contained in the at least two base words selected 184; and, determining the winner of the round by calculating each of the at least two player's score for the round according to the selected criterion for determining the round winner and awarding the winner the round prize amount 185.

Note that the selection and use of at least two base words 182 provides players a greater educational challenge than using only one base word. Referring to FIGS. 5*b*, and *c* and FIG. 6, the actual words that may be formed by rearrangement of letters in the seven letter base words anagram and promise alone and when combined to provide fourteen letters available for use are given (in FIG. 6, only the first 40 or so new words are listed when greater than that number are possible). A perusal of the new words possible exemplifies that, not only are the potential number of words greater when two, versus one, base words are used, but the length of the words increases as well as the sophistication of the words. In the case of these particular two base words when used in combination, new words of eight or more letters are now possible. Thus, using two or more base words in combination greatly expands the ability of players to create longer and more difficult new words. This result increases the educational value of the game over other games that employ only one base word.

Note also that spinning the pointer to determine the round prize amount 16 and the base word length 14, 181, introduces an element of chance in setting the difficulty of play when combined with the selected criterion for determining a round win 30. For example, a base word length 14 of 8 letters combined with a criterion for determining round win 30 of the most words formed of the base word letter length or greater, would provide for a much more difficult and challenging round of play, than, for example, a base word length 14 of 8 letters combined with a criterion for round win 30 of the most words formed. By selecting the criterion for determining a round win 30, players have the ability to vary the level of difficulty and challenge with each game they play.

Repeating the playing a round of the word game step until a player achieves a game win 190. After each round of play 180, a determination is made as to whether a player has won the game according to the selected criterion for determining a game winner 32. If no winner has yet won the game, the playing a round of the word game step 180 is repeated, 190. If, however, a player has won the game, the game ends 200.

As mentioned above, the ability to select a different set of rules for each game played, together with the random selection by spinning of the base word length 14 combines to generate many game combinations.

FIGS. 1*a* to 1*d* illustrate one example of such a combination where play involves two base words 38. The game rules sheet 20 is shown filled out with selections by the players illustrated by "X's" in the checkboxes (see FIG. 1*b*). Players have chosen a time limit 26 of 2 minutes, a qualifying category of new words 28 to include proper words, a criterion for determining a round win 30 of the most words formed of the base word length or greater and a criterion for game win 32 of the first player to gain $10,000 in round prize amounts 16 (see FIG. 1*b*). If this is a bi-lingual version of the word game, the players have chosen the language of play 34 to be english. Their spin of the pointer has determined that the base word length 14 of the two base words 38 they choose will be 7 letters and that the winner of the round will receive $3,000 in prize amount 16 (see FIG. 1*a*). Playing pieces representing two examples of 7 letter base words, anagram and promise, have been placed in the display stand (see FIG. 1*c*). Examples of several new proper words that may be formed from the two base words have been written on the paper 54, each new word being 7 letters or longer (see FIG. 1*d*).

It will be obvious to the reader that many other rules sets may be made by selecting any number of different combinations of rules options 24. A simpler version of the game as illustrated in the present example, would be simply to set the criterion for determining a round winner 30 to the most words formed rather than the most words formed of the base word length 14 or greater. It is much more difficult to form words of seven or more letters than it is to form words of less than seven letters.

While the above description contains many specificities, these should not be construed as limitations on the scope of the invention, but rather as an exemplification of the presently preferred embodiments thereof. The above-described embodiment is set forth by way of example and is not for the purpose of limiting the present invention. It will be readily apparent to those skilled in the art that obvious modifications, derivations and variations can be made to the embodiment without departing from the scope of the invention. For example, a) the base word may be provided in any language;

b) the game pieces may assume variable sizes and shapes and be made of a variety of materials including plastic, wood, and the like;

c) the group of rules options for each rule of play may include more than two options each, and the options may be presented in any number of varieties; and, d) the game rules sheet may be manipulated by players to vary the skill level required to match that of the players so that those of every skill level from elementary to post-graduate may play and benefit from the game.

Accordingly, the scope of the invention should be determined not by the examples given, but by the appended claims and their legal equivalents.

I claim:

1. A word game for play by at least two players, comprising:

a plurality of game pieces each of the game pieces having a rectangular shape with a length and a width greater than its height forming a front and a back broader surface and four narrower edge surfaces, the front and back broader surfaces each having indicated thereon a base word;

a game board comprising a plurality of subdivisions radiating outward from a center of the game board and a pointer rotatably attached to the center of the game board, each of the plurality of subdivisions having indicated thereon a round prize amount to be awarded to a round winner, and a base word length equal to a number of letters in each base word in a set of at least two base words to be played in a current round of play, the at least two base words of the base word length being indicated on a selection of at least two of the plurality of game pieces; and, a timer to time each of an at least one round of play comprising a game.

2. A word game for play by at least two players, comprising:

a plurality of game pieces each of the game pieces having a rectangular shape with a length and a width greater than its height forming a front and a back broader surface and four narrower edge surfaces, the front and back broader surfaces each having indicated thereon a base word;

a game rules sheet on which are listed a group of at least two optional definitions of each of a plurality of game rules, the plurality of game rules comprising:

a time limit rule to specify a time limit for each of an at least one round of play;

a round winner rule to specify a criterion for determining a round winner for each of the at least one round of play; and, a game winner rule to specify a criterion for determining a game winner, a game comprising the at least one round of play; and, a timer to time each of the at least one round of play for the specified time limit.

3. A word game for play by at least two players, comprising:

a plurality of game pieces each of the game pieces having a rectangular shape with a length and a width greater than its height forming a front and a back broader surface and four narrower edge surfaces, the front and back broader surfaces each having indicated thereon a base word;

a game rules sheet on which are listed a group of at least two optional definitions of each of a plurality of game rules;

a game board comprising a plurality of subdivisions radiating outward from a center of the game board and a pointer rotatably attached to the center of the game board, each of the plurality of subdivisions having indicated thereon a round prize amount to be awarded to a round winner, and a base word length equal to a number of letters in each base word in a set of at least two base words to be played in a current round of play, the at least two base words of the base word length being indicated on a selection of at least two of the plurality of game pieces; and, a timer to time each of an at least one round of play comprising a game.

4. A word game for play by at least two players, comprising:

a plurality of game pieces each of the game pieces being rectangular in shape with a length and a width greater than its height forming a front and a back broader surface and four narrower edge surfaces, the front and back broader surfaces each having indicated thereon a base word;

a game rules sheet on which are listed a group of at least two optional definitions of each of a plurality of game rules, the plurality of game rules comprising:

a time limit rule to specify a time limit for each of an at least one round of play;

a round winner rule to specify a criterion for determining a round winner for each of the at least one round of play; and, a game winner rule to specify a criterion for determining a game winner, a game comprising the at least one round of play;

a game board comprising a plurality of subdivisions radiating outward from a center of the game board and a pointer rotatably attached to the center of the game board, each of the plurality of subdivisions having indicated thereon a round prize amount to be awarded to a round winner, and a base word length equal to a number of letters in each base word in a set of at least two base words to be played in a current round of play, the at least two base words of the base word length being indicated on a selection of at least two of the plurality of game pieces; and, a timer to time each of the at least one round of play for the specified time limit.

5. The word game of claim 4, further comprising a paper and a writing instrument for each of the at least two players.

6. The plurality of game pieces according to claim 4, wherein the front and back broader surfaces have further indicated thereon a pronunciation of said base word, and a definition of said base word.

7. The word game according to claim 4, wherein the time limit is selected from the group of at least two optional definitions consisting of one minute, and a player specified limit.

8. The word game according to claim 4, wherein the criterion for determining a round winner is selected from the group of at least two optional definitions consisting of most words formed, and a player-specified criterion.

9. The word game according to claim 4, wherein the criterion for determining a game winner is selected from the group of at least two optional definitions consisting of first player to gain $10,000, and a player-specified criterion.

10. The word game according to claim 4, further comprising a display stand into which the selection of at least two game pieces are inserted to enable viewing by the at least two players.

11. The word game according to claim 4, further comprising a storage container for storing the plurality of game pieces.

12. The word game according to claim 4, wherein the timer is an adjustable timer settable to a plurality of time periods to time each of the at least one round of play for the specified time limit.

13. The plurality of game pieces according to claim 4, wherein the front surface and the back surface of each game piece have further indicated thereon the base word length.

14. The plurality of game rules of claim 4, further comprising a word category rule to specify a category of new words to form that qualify for credit in the at least one round of play, said category of new words being formed from a set of letters contained in the set of at least two base words.

15. The word game according to claim 14, wherein the category of new words to form is selected from the group of at least two optional definitions consisting of proper words and a player-specified type.

16. The word game according to claim 4, wherein the base word indicated on the front surface of each of the plurality of game pieces is in a first language, and the base word indicated on the back surface of each of the game pieces is in a second language whereby a bi-lingual version of the word game is provided.

17. The game pieces of claim 16, wherein the base word indicated on the front surface of each of the game pieces in the first language and the base word indicated on the back surface of the game piece in the second language, share the sharing meaning whereby a bi-lingual translation of the base word is provided.

18. The word game of claim 16, wherein the plurality of game rules further comprise a language of play rule to specify whether a game is to be played in the first language or in the second language.

19. A method for playing a word game by at least two players, comprising:

providing a plurality of game pieces each of the game pieces having a rectangular shape with a length and a width greater than its height forming a front and a back broader surface and four narrower edge surfaces, the front and back broader surfaces each having indicated thereon a base word;

providing a game rules sheet on which are listed a group of at least two optional definitions of each of a plurality of game rules, the plurality of game rules comprising:

a time limit rule to specify a time limit for each of an at least one round of play;

a round winner rule to specify a criterion for determining a round winner for each of the at least one round of play; and, a game winner rule to specify a criterion for determining a game winner, a game comprising the at least one round of play;

beginning play of the word game by defining a set of rules for the game comprising selecting one of the at least two optional definitions for each of the plurality of game rules;

providing a game board comprising a plurality of subdivisions radiating outward from a center of the game board and a pointer rotatably attached to the center of the game board, each of the plurality of subdivisions having indicated thereon a round prize amount to be awarded to a round winner, and a base word length equal to a number of letters in each base word in a set of at least two base words to be played in a current round of play, the at least two base words of the base word length being indicated on a selection of at least two of the plurality of game pieces;

providing a timer to time each of the at least one round of play for the specified time limit;

playing a round of the word game according to the defined set of rules for the game, comprising:

determining a round prize amount and a base word length for the round by spinning the pointer on the game board and noting the round prize amount and the base word length indicated on the subdivision at which the pointer lands;

determining the at least two base words for play in the round by selecting at least two of the plurality of game pieces of the base word length for the round of play;

beginning the round of play by starting the timer and to timing the round of play for the specified time limit;

forming as many new words of the selected type of new words as possible within the specified time limit from a set of letters contained in the at least two base words selected; and, determining the winner of the round by calculating each of the at least two player's score for the round according to the selected criterion for determining the round winner and awarding the winner the round prize amount; and, repeating the playing a round of the word game step until one of the at least two players achieves a game win according to the selected criterion for determining a game winner.

20. The method for playing a word game according to claim 19, wherein the time limit is selected from the group of at least two optional definitions consisting of one minute, and a player-specified limit.

21. The method for playing a word game according to claim 19, wherein the criterion for determining a round winner is selected from the group of at least two optional definitions consisting of most words formed, and a player-specified criterion.

22. The method for playing a word game according to claim 19, wherein the criterion for determining a game winner is selected from the group of at least two optional definitions consisting of first player to gain $10,000, and a player-specified criterion.

23. The method for playing a word game according to claim 19, wherein the plurality of game rules further comprise a word category rule to specify a category of new words to form that qualify for credit in the at least one round of play.

24. The word game according to claim 23, wherein the category of new words to form is selected from the group of at least two optional definitions consisting of proper words and a player-specified type.

25. The playing a round step of claim 19, further comprising placing the selection of at least two game pieces into a display stand thereby enabling viewing of the at least two base words by the at least two players.

26. The forming as many new words of the selected type of new words as possible step of claim 19, further comprising writing the new words on a paper by means of a writing instrument.

27. The method for playing a word game of claim 19, wherein the base word indicated on the front surface of each of the plurality of game pieces is in a first language, and the base word indicated on the back surface of each of the game pieces is in a second language thereby providing a bi-lingual version of the word game.

28. The game pieces of claim 27, wherein the base word indicated on the front surface of each of the game pieces in the first language and the base word indicated on the back surface of the game piece in the second language, share the same meaning, thereby providing a bi-lingual translation of the base word.

29. The method of playing a word game of claim 27, wherein the plurality of game rules further comprise a language of play rule to specify whether a game is to be played in the first language or in the second language.

30. A bi-lingual word game for play by at least two players, comprising:

a plurality of game pieces each of the game pieces having a rectangular shape with a length and a width greater than its height forming a front and a back broader surface and four narrower edge surfaces, the front and back broader surfaces each having indicated thereon a base word, and the base word indicated on the front surface is in a first language, and the base word indicated on the back surface is in a second language;

a game rules sheet on which are listed a group of at least two optional definitions of each of a plurality of game rules, the plurality of game rules comprising:

a time limit rule to specify a time limit for each of an at least one round of play;

a round winner rule to specify a criterion for determining a round winner for each of the at least one round of play; and, a game winner rule to specify a criterion for determining a game winner, a game comprising the at least one round of play;

a game board comprising a plurality of subdivisions radiating outward from a center of the game board and a pointer rotatably attached to the center of the game board, each of the plurality of subdivisions having indicated thereon a round prize amount to be awarded to a round winner, and a base word length equal to a number of letters in each base word in a set of at least two base words to be played in a current round of play, the at least two base words of the base word length being indicated on a selection of at least two of the plurality of game pieces; and, a timer to time each of the at least one round of play for the specified time limit.

31. The word game of claim 30, further comprising a paper and a writing instrument for each of the at least two players.

32. The plurality of game pieces according to claim 30, wherein the front and back broader surfaces have further indicated thereon a pronunciation of said base word, and a definition of said base word.

33. The plurality of game rules of claim 30, further comprising a word category rule to specify a category of new words to form that qualifies for credit in the at least one round of play, said category of new words being formed from a set of letters contained in the set of at least two base words.

34. The word game of claim 30, wherein the plurality of game rules further comprise a language of play rule to specify whether a game is to be played in the first language or in the second language.

35. The word game according to claim 30, further comprising a display stand into which the selection of at least two game pieces are inserted to enable viewing by the at least two players.

36. The word game according to claim 30, further comprising a storage container for storing the plurality of game pieces.

37. The word game according to claim 30, wherein the timer is an adjustable timer settable to a plurality of time periods to time the round of play for the specified time limit.

38. The plurality of game pieces according to claim 30, wherein the front surface and the back surface of each playing piece have further indicated thereon the base word length.

39. The game pieces of claim 30, wherein the base word indicated on the front surface of each of the game pieces in the first language and the base word indicated on the back surface of the game piece in the second language, share the same meaning to provide a bi-lingual translation of the base word.

* * * * *